US011441376B2

(12) United States Patent
McLaughlin

(10) Patent No.: US 11,441,376 B2
(45) Date of Patent: Sep. 13, 2022

(54) DIGITALLY CONTROLLED AGITATION SWITCH SMART VIBRATION ASSEMBLY FOR LATERAL WELL ACCESS

(71) Applicant: Stuart McLaughlin, Magnolia, TX (US)

(72) Inventor: Stuart McLaughlin, Magnolia, TX (US)

( * ) Notice: Subject to any disclaimer, the term of this patent is extended or adjusted under 35 U.S.C. 154(b) by 43 days.

(21) Appl. No.: 16/765,457

(22) PCT Filed: Nov. 19, 2018

(86) PCT No.: PCT/US2018/061889
§ 371 (c)(1),
(2) Date: May 19, 2020

(87) PCT Pub. No.: WO2019/100033
PCT Pub. Date: May 23, 2019

(65) Prior Publication Data

US 2020/0284113 A1 Sep. 10, 2020

Related U.S. Application Data

(60) Provisional application No. 62/588,378, filed on Nov. 19, 2017.

(51) Int. Cl.

| | |
|---|---|
| ***E21B 28/00*** | (2006.01) |
| ***E21B 6/06*** | (2006.01) |
| ***E21B 31/03*** | (2006.01) |
| ***F03B 13/02*** | (2006.01) |

(52) U.S. Cl.
CPC ..... *E21B 28/00* (2013.01); *E21B 6/06* (2013.01); *E21B 31/03* (2013.01); *F03B 13/02* (2013.01)

(58) Field of Classification Search
CPC ..... E21B 4/02; E21B 6/06; E21B 7/24; E21B 21/10; E21B 28/00
See application file for complete search history.

(56) References Cited

U.S. PATENT DOCUMENTS

| | | | | |
|---|---|---|---|---|
| 6,050,349 | A * | 4/2000 | Rountree | E21B 47/20 175/40 |
| 6,970,398 | B2 * | 11/2005 | Lavrut | E21B 47/20 367/84 |
| 2017/0205523 | A1 * | 7/2017 | Song | E21B 47/00 |
| 2019/0024459 | A1 * | 1/2019 | Sicilian | E21B 34/10 |

* cited by examiner

*Primary Examiner* — Tara Schimpf
(74) *Attorney, Agent, or Firm* — Kearney, McWilliams & Davis, PLLC; William C. Yarbrough

(57) ABSTRACT

A downhole device comprising a novel apparatus and vibratory assemblage that initiates and maintains mechanical agitation within the horizontal section of a well bore by providing both low and high vibration, in multiple axes and planes, and through pulsing of high-pressure fluids within the confines of the apparatus and drilling pipe. Through the judicious and conservative use of fluids, the present invention provides both rotationally accelerated low and high vibration and high-intensity, directed and timed pressure to reduce the cumulative friction between the drill string and bottom hole assembly on a wellbore. Additionally, the present apparatus can be preprogrammed to respond to specific commands, in response to certain predetermined conditions, to stop and start functioning at various times throughout the drilling process.

27 Claims, 11 Drawing Sheets

DIGITALLY CONTROLLED AGITATION SWITCH SMART VIBRATION ASSEMBLY FOR LATERAL WELL ACCESS

CROSS-REFERENCE TO RELATED APPLICATIONS

Priority claimed to Provisional Application U.S. Ser. No. 62/588,378 filed on Nov. 19, 2017.

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Field of the Invention

The present invention provides a novel apparatus and vibratory assemblage that initiates and maintains mechanical agitation within the horizontal (lateral) section of a wellbore by providing both low and high vibration, in multiple axis and planes, and pulsing of high-pressure fluids within the confines of the apparatus and drilling pipe. Through the judicious and conservative use of fluids, the present invention provides both rotationally accelerated vibration and high-intensity, directed and timed pressured fluid to reduce the cumulative friction between the drill string and bottom hole assembly on a wellbore. Additionally, the present apparatus can be preprogrammed to respond to specific commands, in response to certain predetermined conditions, to stop and start functioning at various times throughout the drilling process.

Manifestly, it is friction within the horizontal sections of a wellbore that ultimately leads to decreases in downhole advancement and overall decreases rate of penetration (ROP). In horizontal drilling, as the drill string transitions through the heal and begins a horizontal advancement down the wellbore, the forces upon the drill string and BHA experience mechanical drag due to frictional forces that work counter to the drill strings ability to advance.

Ultimately, the maximum reach of the drilling assembly is determined, jointly, by driving force and opposing axial frictional forces where these frictional forces consist primarily of torque and drag. While the application of more force results in more weight on bit (WOB), and thereby further advancement of the BHA, it also creates untoward string buckling (helically and/or sinusoidally) that (1) disallows increases in weight to be distributed to the bit proportionally with increased force and (2) unwanted tangential frictional forces along the preceding sections of the wellbore behind the BHA.

To overcome the limits of excess torque and drag, well operators and petroleum engineers have developed several methods to overcome these limitations in order to effectively reach greater and greater depths and lengths within the wellbore. As is the case with unconventional drilling and ultra-extended reach wells (u-ERW), chemical and mechanical methods have been employed to reduce the friction experiences between drill strings, bottom hole assemblies and wellbores. Yet, chemical lubricant additives carry with them excessive cost, both environmental and financial, that make their use untenable. Mechanical methods, though, have proven both cost effective and environmentally safe. By far the most utilized of the mechanical methods of reducing torque and drag is the employment of vibratory technologies. In addition, driller have increasingly turned to a fluid percussive means of advancing the drill string and BHA through the wellbore.

Mechanical systems to vibrate or agitate the pipe as it enters the well are known in the industry as agitators, vibratory or extended reach tools. These extended reach tools are typically attached near the end of the pipe that will be farthest in the well and are made to excite the distal portion of the drill string and bottom hole assembly to avoid or cure the consequences of frictional forces. The extended reach tools currently available, though, cannot be switched "On or Off" when fluid is pumped through them and are designed such that when fluid enters the extended reach tool it automatically starts to vibrate downhole assemblies due to the binomial physical mechanics of the system. They have no "On or Off" switch and no ability to be commanded to activate or deactivate.

Equally, there is also no ability in today's extended reach tools to activate multiple assemblies at different depth in the well using different well bore conditions.

The present invention eliminates automatic activation when fluids are pumped down the drill string and can be set up to be activated only when commanded through a programmable interface. The ability to achieve this configurable setup greatly enhances the ability to deliver pipe and bottom hole assemblies effectively and efficiently to even farther depths of an extended reach horizontal wellbore.

Clearly, there remains an unmet need for a downhole apparatus capable of effectively and efficiently utilizing fluid forces to induce both high and low vibratory forces, while harnessing fluid pressure, to create vibratory and percussive forces that advance a drill string in both a resource constrained and resource efficient manner. Moreover, there is a long-felt and unmet need in a vibratory assemblage that can have its functions initiated and ceased upon experiencing programmed parameters. The present invention seeks to remedy the aforementioned infirmities in the prior art.

SUMMARY OF THE INVENTION

The present invention offers vast improvements over that of today's agitation, vibratory and extended reach tools by offering an ergonomic, uniquely ported valve and turbine-linked rotational shaft fluid system to provide pressurized fluid to achieve the dual function of rotational vibratory excitement of a tubular agitator and a timed, pressurized fluid jet to effectuate friction-freeing forces between a drill string and horizontal pipe. It is another goal of the inventor to incorporate an "On and Off" programmable capability, unseen in today's systems, to conserve the finite wear experienced by downhole tools and related bottom hole assemblies.

The present invention provides for a uniquely designed pressurized agitator exhibiting a digital programmable interface which is set to activate the vibratory assemblage only when wellbore or pipe conditions are met (such as well angle well temperature, weight on bit, etc). Subsequently, once a set of conditions are met, a manual brake probe is commanded to unlock a shaft, allow pumped fluid to translocate through a series of rotationally accessible ports, rotate a set of shaft-affixed turbines (thereby permitting rotation of the shaft and a ported rotational plates), create an increasingly pressurized interior environment and to rotate a temporally operated aperture to allow for a forced pressurized exodus to attached bottom hole assemblies. The multi-axis vibration created by the rotation of the shaft and ported plates generates the vibration as well as the delivered fluid pressure jet necessary to deliver the bottom hole assemblies successfully to the end of the wellbore section of the well efficiently and effectively.

In detail, the vibratory assembly uses a series of valves and rotating turbines to induce vibration when fluid is pumped down the drill string and into the assembly where a turning the shaft, fueled via finned turbines, provides rotational movement, as well as pressurized fluid flow to a rotationally operable exit port, to create a high to low range intensity vibration combined with a high intensity fluid jet ahead of the assembly. This turbine-powered, rotationally operable shaft, which may include an integral offset weight, causes fluid-controlled circular rotation in the assembly to induce vibration on the first axis. In both the upper turbine housing and the bearing valve housing of the assembly, rotating plates exhibited circumferentially about the interior of each tubular, and perpendicular to the tubular annular flow direction, allows fluid to pass through reciprocal ports in a secondary static plate to create an environment of increasing pressure as fluid travels from the proximal end to the distal end of the assembly. As the fluid passes through the rotating plate, the ports open and close across the static plate. As will become clear from the present disclosure, differing the ports configuration by opening and occlusion of these ports can induce or relieve the pressure and rotational speed housed within the assembly. Once introduced, fluid entrance causes a momentary pressure increases within each respective distal portions of both the upper turbine housing and the bearing valve housing of the assembly. This fluid pressure increase establishes (1) a retrograde pulse that is then directed back up the vibratory tool and along the pipe laying in the horizontal well section and (2) anticipates a forward timed jet of fluid pressure created through a shaft-controlled rotational uni-ported system, similar to the circumferentially designated plurality of ports about the interior of both the upper turbine housing and bearing valve housing, that creates one large egressing fluid pulse forward as a ported rotational disc comes into communicating with a stationary orifice. Vibration rate is controlled by fluid speed and pressure (i.e. as fluid is pumped through the tool at an increasing rate the higher and faster the fluid pulses travel along the pipe, the greater the rotational speed that is experienced by the shaft in revolutions and the rapidity with which exiting pulses is experienced). Further, the parameters of the rotating turbines (e.g. fin pitch, outer diameter, circumference, fin thickness etc.) can positively or negatively affect the frequency of the vibratory forces and the pressure created in the final fluid pressure force. Too, as alluded to, the diameter, shape, placement and number of circumferential ports can have correspondingly inhibitory and promotional influences on the creation of pressure within the agitator's annulus. This pulsing effect causes the pipe to vibrate along its lateral length effecting not only the frictional forces created at the site of the bottom hole assembly but also in a retrograde manner up the drill string. Succinctly, as fluid is pumped down the drill string to the BHA, the rotational plates spins, the first rotational port of the first rotating plate align with the first static plate ports and the fluid is allowed to pass distally through to the assembly turbines which in turn rotates the centrally disposed shaft to propagate fluid flow down the assembly and create vibration, rotate an affixed rotational disc and to expel a concentrated, fluid jet to the forward attached assembly.

Similarly, in the case of an offset weight, as the fluid rate increases, the rotational speed of the turbines increase which in turns makes the weighted shaft rotate at a faster and faster rate. This increase in offset weighted shaft rotation causes the assembly to vibrate at higher rates of speed through increased rotation which in turn increases the vibratory force within the wellbore and reduces the pipe on pipe friction in the lateral direction of the horizontal section of the wellbore.

As above, the weighted shaft, turbines and rotational plate can be readily replaced with higher or lower ratios of weight, ports and propeller configurations to allow for far higher or far lower vibratory functions to be achieved (as well as lower to higher pressure jet pulses expelled distally from the assembly). The modular design, too, allows for inclusion and exclusion of communicating and noncommunicating ports, placement and replacement of differing sixes and shaped turbines and the inclusion, exclusion and sequential placement of complete sections of the assembly itself (e.g. turbine housings, bearing valve housings and vent sub housings)

In terms of conservation of equipment, the assembly that is the present invention can be made to exhibit an onboard digital assembly including a printed circuit board, electrical motor, brake probe, battery power section and onboard sensors to both determine if and when a set of preprogrammed determinates have been satisfied in actuating or stopping the functioning of the assembly. This digital component to the assembly a key feature unique to the operation of the vibratory assembly in that agitation tools typically cannot be turned "on and off" in a wellbore. Customarily, as soon as fluid is pumped down the pipe, the agitation tool will start to vibrate the entire pipe string, pressure will begin to build and timed pressure pulses will begin to be expelled from the assembly. This agitation motion is not required in the vertical section of the well and provides unwanted wear and tear on both surface and downhole equipment unnecessarily.

This onboard digital assembly incorporated into the vibratory assembly allows for agitation to be commanded to start or stop by preprogramming specific instruction into the microprocessor within the tool via a printed circuit board. These programmed commands can follow any number of parameters, set of parameters or sets of parameters which when encountered can stop or start the functional operation of the assembly.

An example of these instructions is listed below which start and stop the agitation motion even when the pumps are switched on and fluid is flowing through the tools:

1. Apply Brake Probe when wellbore angle is between '0' and 69 degrees.
2. Release Brake Probe when wellbore angle is or exceeds 70 degrees.

Or

1. Apply brake probe when well bore angle is between '0' and '69' degrees and temperature is below 100 degrees centigrade.
2. Release Brake Probe when well bore angle is or exceeds 70 degrees and well bore temperature is or exceeds 100 degrees centigrade.

While the above or only examples of programmed commands to activate the vibratory tool from idle to agitation mode, these are two of the primary features that designate the proper section of the wellbore for initiation of agitation, vibration and fluid pulsation. This programmable configuration allows the tool to remain idle (i.e. not vibrate) in a predefined section of the well (e.g. lateral sections) thereby eliminating unwanted vibration and fatigue on the pipe string and attached tool string (BHA).

Other sensors can easily be incorporated into the assembly at the operator's preference to provide alternate means of "On/Off" activation deactivation commands and some of these would be as follows:

- Use of a weight on bit sensor to command the tool to turn on and off,
- Use of a torque sensor to command the tool to turn on and off.
- Use on a G force sensor to command the tool to turn on and off.
- Use of an inclination sensor to command the tool to turn on and off.

Therefore, as included above, it can be seen that a variety of sensors can be used as the 'trigger' without departing from the scope and spirit of the onboard digital assembly and it is the interchangeable and additive predetermined "triggers" that add to the versatile operational selectivity of the various modes of operation and uses.

Structurally, the vibratory assembly is typically attached to the pipe or coiled tubing pipe and or snubbing pipe near the bottom hole assembly. This allows for the bottom hole assembly to be agitated both during deployment along the horizontal section of the well but also while drilling to enhance drilling operations. The agitation system when applied to jointed pipe can be used in multiple locations such as at the bottom hole assembly and along the end of the lateral wellbore, at the well section known as the heel or the lateral curve of the well, from horizontal to vertical and also in various portions of the vertical section as required by the operator. The key advantages of this multiple section vibratory assembly is that tools will activate when a preprogrammed well condition is present (such as well bore angle and well bore temperature) and each tool can be programmed to activate at different well bore conditions.

In opposite from direct drilling actives, upon the pipe and BHA recovery from the well, the preprogrammed vibratory tool can be programmed to again recognize wellbore conditions and or environmental factor (and once conditions are reached), the onboard digital assembly can deactivate the vibratory tool assembly. So in the above example, the tool will activate once 70 degrees deviation is achieved and 100 degree centigrade conditions are met and, conversely, the vibratory tool assembly will stop vibrating (deactivating) once the lesser of these two example conditions are seen (i.e. 69 degrees or less deviation is achieved and/or <100 degree centigrade is experienced). This again eliminates vibration of the entire pipe and bottom hole assembly in the vertical section and greatly reduces wear and tear on surface and downhole equipment.

BRIEF DESCRIPTION OF THE DRAWINGS

The advantages and other aspects of the invention will be readily appreciated by those of skill in the art and better understood with further reference to the accompanying drawings in which like reference characters designate like or similar elements throughout the several figures of the drawings and wherein.

Drawings

DETAILED DESCRIPTION OF THE PREFERRED EMBODIMENTS

The present invention allows for pipe vibration to be applied to any joint, seamless, coiled or snubbed pipe configuration whether threaded or not. The present invention allows for pipe to be delivered to lateral sections of a well with the aid of vibratory tools that excite pipe in multiple axes. This agitation process is achieved by pumping fluids through a series of ported discs and turbine-exhibiting shafts that oscillate the vibratory assembly 100 and creates both vibration of the pipe and fluid pulses within the pipe to educe friction between similar and dissimilar materials.

Figure 1:
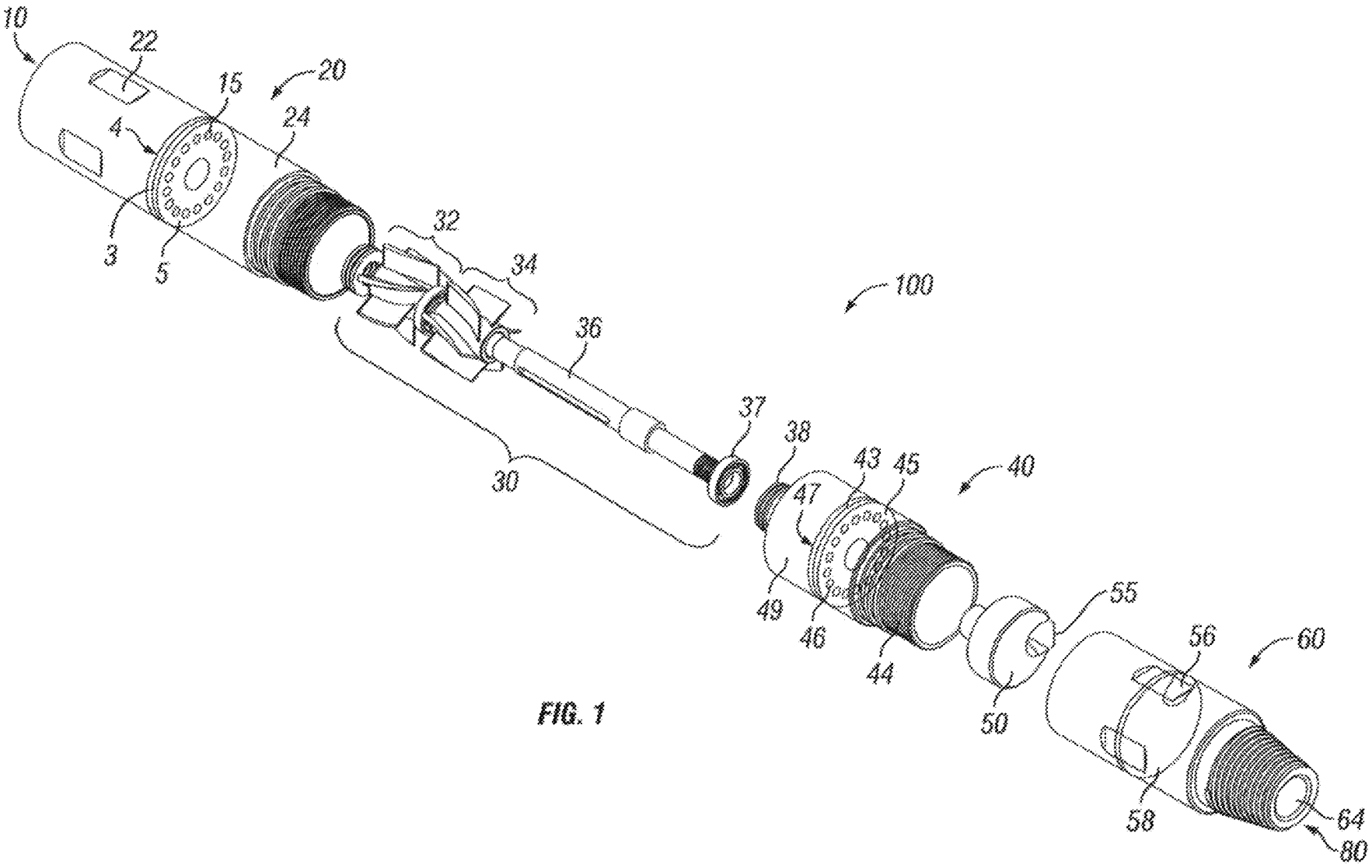
FIG. 1 shows an exploded view of the entire vibratory assembly.

As depicted in FIG. 1, the vibratory assembly 100 that is the present system uses a series of valves and rotating turbines wherein the vibratory assembly 100 induces vibration when fluid is pumped down the drill string and into the vibratory assembly 100 thereby turning the shaft 36, via finned turbines 32,34, that provide rotational movement, as well as pressurized fluid flow to a rotationally operable exit port 56, to create a variable high to low range intensity vibration combined with a high intensity fluid jet ahead of the assembly. This turbine-powered, rotationally operable shaft 36, which may include an integrated offset weight (not shown), causes fluid-controlled circular rotation in the assembly 100 to induce vibration on the first axis. In both the upper turbine housing 20 and the bearing valve housing 40 of the assembly, rotating plates 3, 43 exhibited circumferentially about the interior of each tubular 20, 40 and perpendicular to the tubular annular fluid flow direction, allows fluid to pass from rotational inlet flow ports 4, 47 in rotational plates 3, 43 through reciprocal stationary ports 15, 46 in stationary plates 5,45 to create an avenue and environment of increasing pressure as fluid travels from the proximal end 10 of the vibratory assembly 100, through the upper turbine housing 20, through the bearing valve housing 40, into the lower vent sub 60 and through the distal end 80 of the assembly.

As the fluid energizes and passes through each rotating plate 3, 43, the rotating plate ports 4, 47 of rotating plates 3, 43 come into communication with stationary plate ports 15, 46 which open and close across each static stationary plate 5, 45, Each rotating plate being affixed to shaft 36 further potentiating shaft 36's rotational movement. This fluid entrance causes a sudden, momentary pressure increase within each respective distal portion 24, 44 of both the upper turbine housing 20 and the bearing valve housing 40 of the vibratory assembly 100. This fluid pressure increase is experienced rearward as well as forward where increased pressure establishes (1) a retrograde pulse that is then directed back up the vibratory tool and along the pipe laying in the lateral well section (with the uncommunication of rotational inlet flow ports 4, 47 and stationary inlet flow ports 15, 46) and (2) anticipates a forward timed "jet" of fluid pressure created through a turbine-shaft assembly 30 controlled rotational uni-ported system (created via a temporal, rotational communication between rotating aperture 55 and stationary orifice 56), similar to the circumferentially designated plurality of inlet flow ports 15, 47 made to communicate and uncommunicated with inlet flow ports 15, 46 and about the interior of both the upper turbine housing 20 and bearing valve housing 40, where each smaller inlet flow port 4, 15, 47, and 46 creates incrementally larger increases in internalized tubular pressure, rotating aperture 55 and stationary orifice 58 creates one large egressing fluid pulse forward as the rotating ported rotational disc 50 rotates, through rotational locomotion of the turbine-shaft assembly 30, and comes into communication with a stationary orifice 56 in stationary plate 58 that exists perpendicular to the annular tubing that is the lower vent sub 60. In sum, each rotating plate 3, 43 and 50 creates a retrograde and forward pulsation experienced through closure and opening of ports 4 and 15, 47 and 46 and 55 and 56, respectively.

Figure 4:
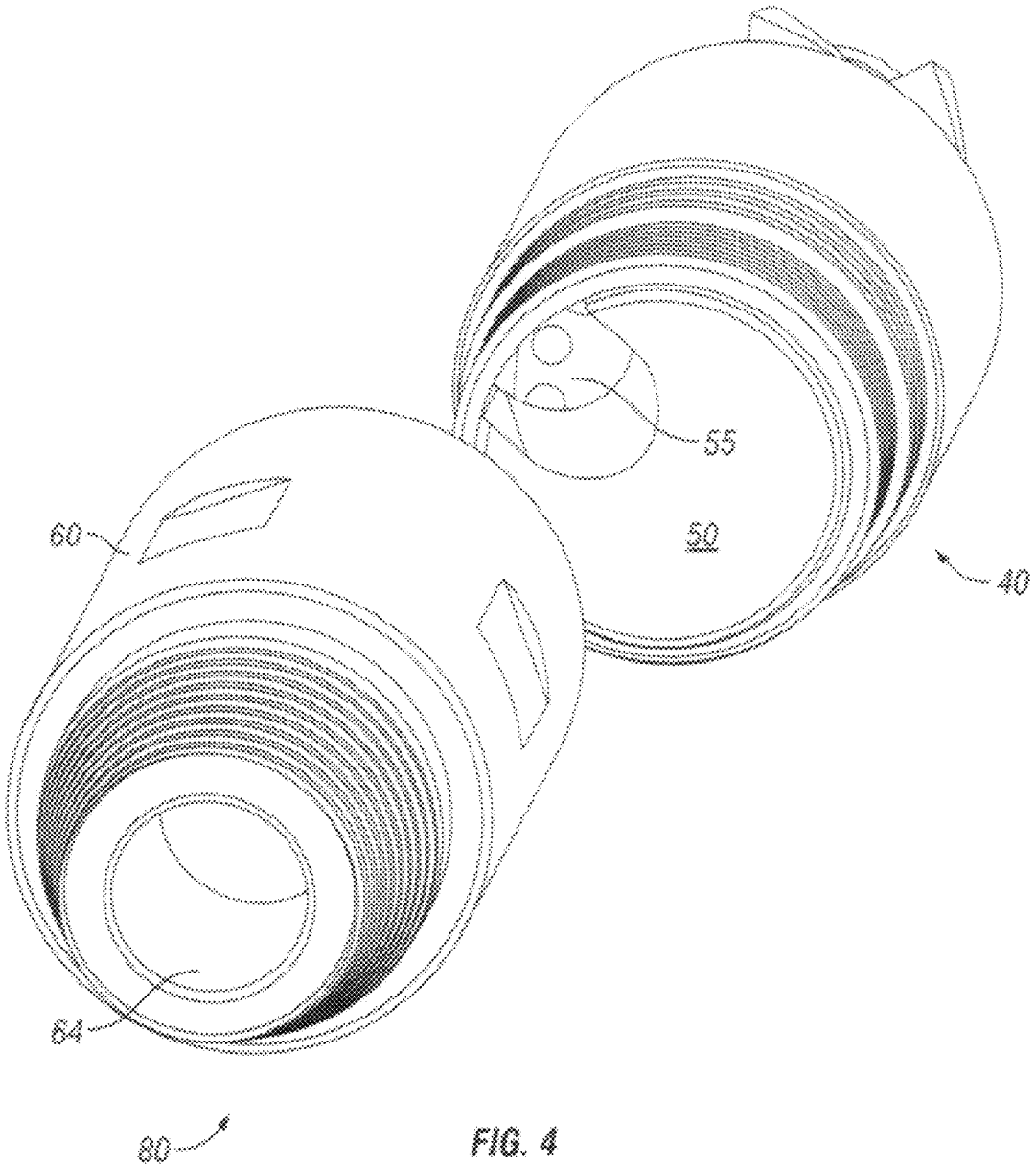
FIG. 4 depicts the lower vent sub and bearing valve housing of the present invention.
Figure 5:
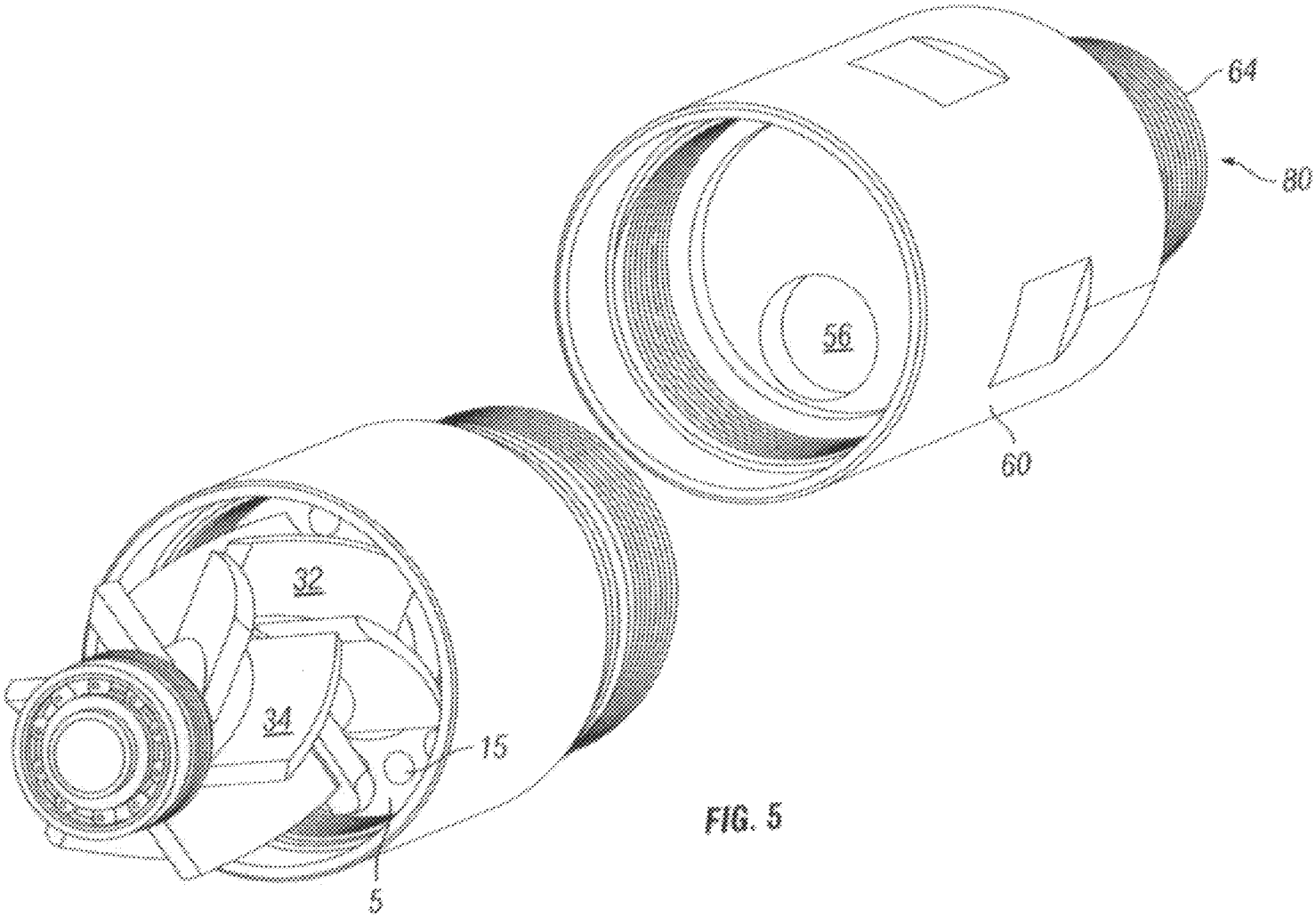
FIG. 5 shows the twin turbine propulsion system and interior of the lower vent sub with stationary orifice.

It should be noted that variations of number, configuration and placement of circumferentially located rotating inlet ports 4, 47 of rotating plates 3, 43 and stationary inlet ports 15, 46 of stationary plates 5, 45, fluid pressure regulation of rotating plates 3, 43 and their temporal communication with corresponding receiving orifices in reciprocating stationary plates 5, 45 and 58, variations of number, configuration and placement of circumferentially located rotating port 55 (or various other ports not shown) in disc 50 (as seen in FIG. 4) and or orifice 56 (or orifices—not shown) (as seen in FIG. 5) in stationary plate 58 can be augmented to either increase or decrease the pressure pulses and vibratory forces the vibratory assembly 100 is capable of producing.

As well, the configuration of the turbines 32, 34, in terms of turbine blade length, blade pitch, blade circumference and blade thickness, among other physical features, may be modified to (1) increase or decrease pressure or flow within the vibratory assembly 100, increase or decrease vibratory intensity within the vibratory assembly 100 and/or increase or decrease the pressure pulse expressed through the most distal opening (foot valve 64) of the vibratory assembly 100. And, their placeable and replaceable "keyed" inclusion upon the assembly shaft 36 more readily lends itself to an easily and readily modifiable configuration for different and differing vibration intensities and fluid pressure creation.

Turbines

The use of a fluid powered turbine is a simple and reliable method for rotation of a drive shaft 36 to operate a valve or other devices. However, a single turbine 32 may require a speed controller to prevent revolutions exceeding the limits of the turbine given a certain flow rate through the turbine. Various methods of speed control exist but can be both complex and expensive such that they reach impracticability (e.g. magnetic speed controllers).

To alleviate thus issue, the present invention utilizes a reverse pitch on the second turbine 34 in the tandem series. Further, a variable diameter turbine 32, 34 is used in the current embodiment to provide speed control of the upper/primary turbine 32 within each power section (upper turbine 2 and lower turbine 34) of the entire turbine-shaft assembly 30. By changing the pitch, diameter, number of blades and/or thickness of blades (or a combination of all features) the operator can alter the revolutions per second of the turbine-shaft assembly 30. Individually, only one turbine requires pitch and or diameter change within the upper and lower power sections, though, and by changing the dimensions of one of the turbines, for example turbine 34, this will provide the required drag to be placed on the other turbine, or example turbine 32, thereby slowing turbine 32 down—each keyed into the same drive shaft.

Too, upper power section turbines 32 can be set up with a different pitch and diameter turbines from the lower power section turbines 34 where the rotational direction of each turbine 32,34 are opposite from one another. For example, if turbine 32 is designed for a clockwise rotation, turbine 34 is designed for a counterclockwise rotation and, conversely, if turbine 32 is designed for a counterclockwise rotation, turbine 34 is designed for a clockwise rotation. Therefore, turbine 34 is creating the necessary deleterious function (i.e. drag) retarding the spin of turbine 32 (as shown in FIG. 5). By constructing each turbine 32 and 34 with a different directional flow and a difference in pitch and diameter, an operator can create a power section that can be manipulated to rotate at various and variable revolutions per second.

In addition, because all the turbines 32 and 34 are individually attached to the drive shaft they can be manufactured (e.g. 3D metal printed) with a combination of pitch and diameter augmentations and modifications as to provide for an array of turbine speeds and provide a vast combination of revolution per second variables with due attention paid to the durable thickness and durability required by all downhole equipment. It is this ability to use modular turbines located in series on a primary drive shaft 36 which makes for a truly versatile, variable speed controller.

Figure 2:
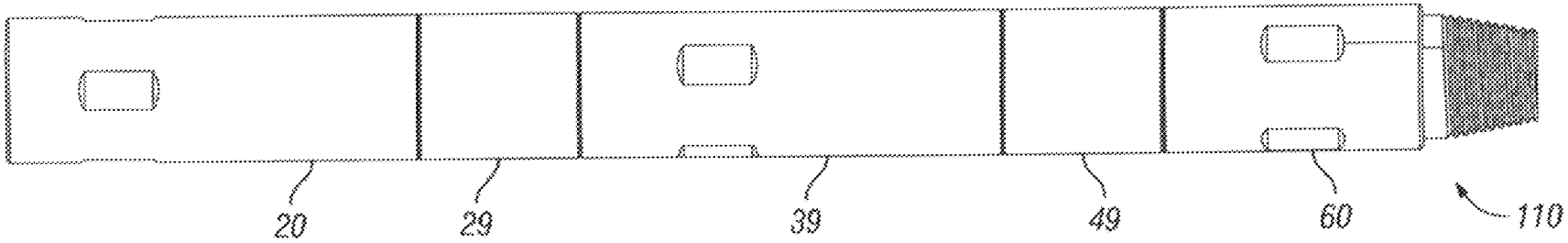
FIG. 2 illustrates a side view of the exterior of the vibratory tool system assembly in series.
Figure 6:
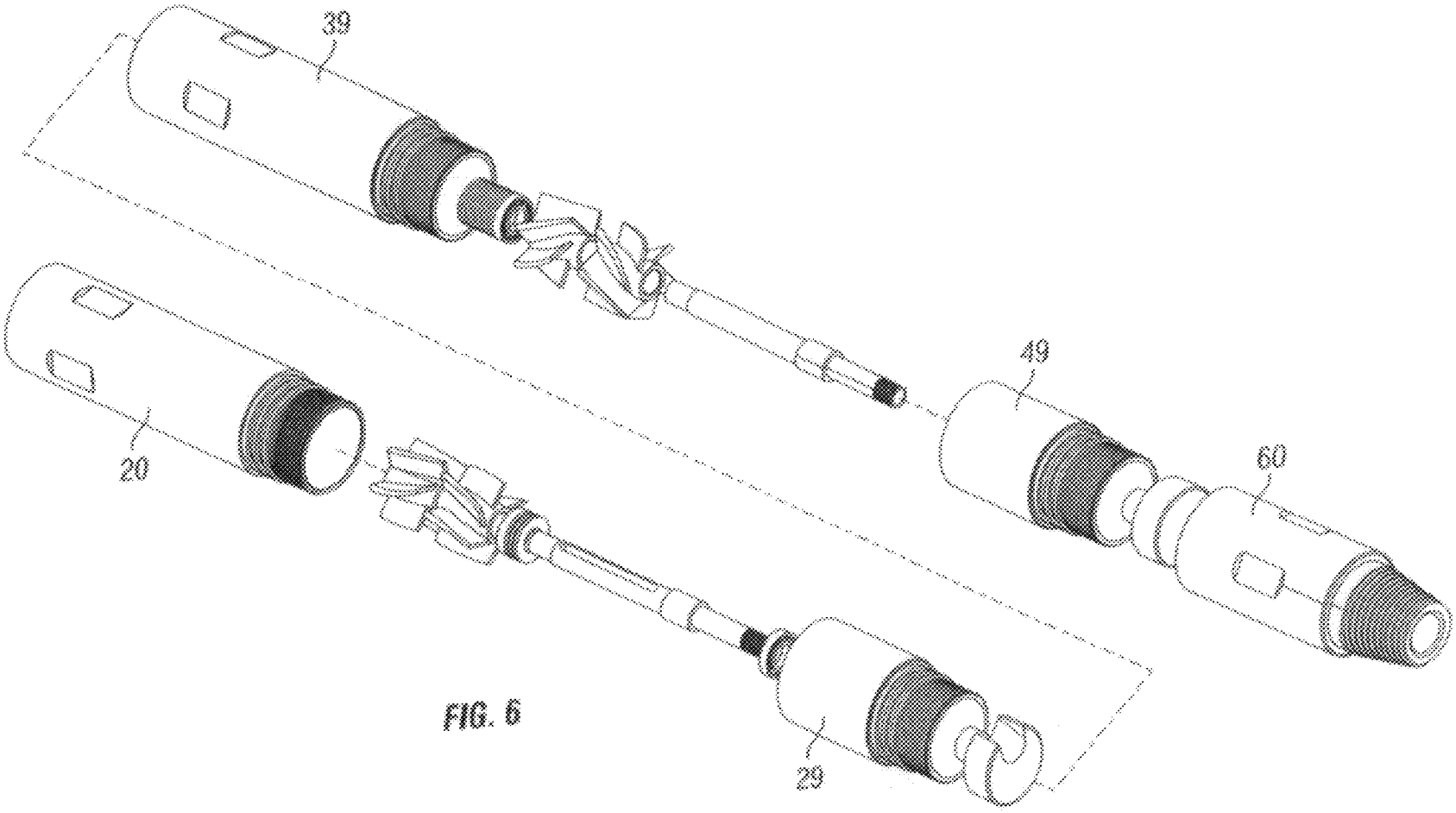
FIG. 6 depicts an exploded view of the vibratory tool system sections.

FIG. 2 depicts the outer shell and FIG. 3 the inner functional components of the present invention that is the vibratory assembly system 110 which is run in series (tandem) where the vibratory agitator assembly 100 is connected in the following manner: upper turbine housing 20 to an upper bearing valve housing 29 to a lower turbine housing 39 to a lower bearing valve housing 49 to a lower vent sub 60. FIG. 6 further shows an exploded view of the conjunction of the individual subunits of vibratory agitator assembly 100 as shown connected in FIGS. 2-3.

Figure 3:
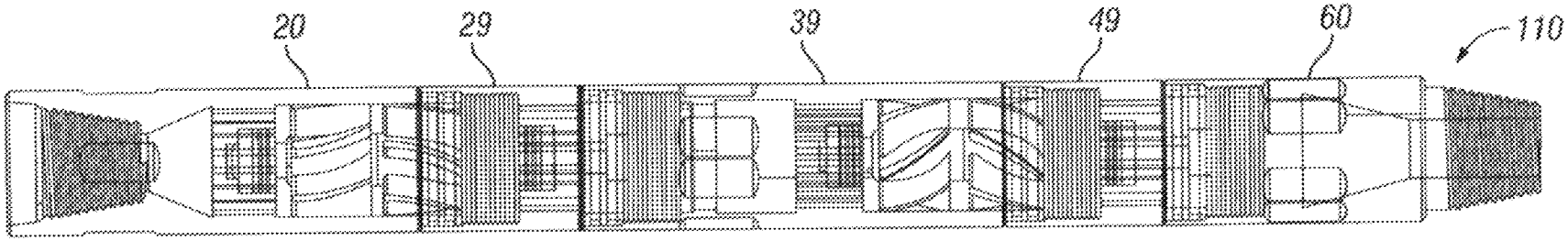
FIG. 3 shows the vibratory tool system dissected along the midline.

In FIGS. 2, 3 and 6 the vibratory assembly system 110 can be seen to run in tandem or series wherein the upper turbine housing 20 can be made to function at a high vibratory intensity (e.g. 40 Hz) and the lower turbine housing 39 can be made to function at a low vibratory intensity (e.g. 10 Hz). Alternatively, the upper turbine housing 20 can be made to function at a low vibratory intensity and the lower turbine housing 39 can be made to operate at a high vibratory intensity. Through this combination of vibratory assemblies 100 into a sequential vibratory assembly system 110, the present invention is capable of simultaneously generated high and low frequency vibration. What's more, the vibratory assembly system 110 can be placed at various location above the drill bit to facilitate rate and depth of penetration.

Plainly, each turbine housing 20 and 39 is made up of a ported housing that permits control of fluids to each power section 20 and 39. Each of the individual flow ports 4,15 and 47, 46, within either turbine housing 20 and 39 and bearing housing 29 and 49, respectively, can be threaded to allow for isolation of a number of ports educe or increase the rate of flow through the upper, lower or both upper and lower power sections 20 and 39. The ability to control flow into each power section 20 and 39 and bearing valve housing 29 and 49 allows for variable pressure pulse heights to be readily achieved thereby creating a higher or lower "water hammer" or pulse jet effect. This will also allow for variable pressure drops across the tools that can be readily changed with reconfiguration of the components, of both the vibratory assembly 100, individually, and the sequential vibratory system 110, in combination, by closing off of ports in the event that higher or lower flow rates require rate and adjusting pressure and pulse intensities to achieve desired vibration generation together with maximum pressure pulse effect as the fluid passes through the lower turbines and exits the foot valve 64 in the lower sub (as seen FIG. 4).

Moreover, just as vibration rate is controlled by fluid speed and pressure as fluid is pumped through the tool at an increasing rate, the higher and faster the fluid pulses travel along the pipe, the greater rotational speed is experienced by the shaft in revolutions and the rapidity with which exiting pulses is experienced), so too is flow further augmented within the vibratory assembly 110 and the sequential vibratory system 110. It is the case that the parameters of the rotating turbines 32, 34 (e.g. fin pitch, outer diameter, circumference, etc.) can positively or negatively affect the frequency of the vibratory forces and the pressure created in the final fluid pressure force. Too, the diameter, shape, placement and number of circumferential ports 4, 15, 47, 46 can have correspondingly inhibitory and/or promotional influences on the creation of pressure within the agitator's annulus.

In addition to the vibratory forces, pulsing effects cause the pipe to vibrate along its lateral length effecting not only the frictional forces created at the site of the bottom hole assembly but also in a retrograde manner up the drill string. Succinctly, as fluid is pumped down the drill string to the BHA, pressurized fluid contacts and rotates rotational plates 3 and 43, the first rotational ports 4 of the first rotating plate 3 aligning with the first static plate 5 ports 15 wherein fluid is allowed to pass distally, when such ports 4, 15, 47 and 46 are aligned, through to the assembly turbines 32, 34 which in turn rotates the centrally disposed shaft 36 to propagate fluid flow down the assembly and create vibration, rotate an affixed perpendicularly appended rotational disc 50 and to expel a concentrated, fluid jet through the communication of aperture 55 through stationary orifice 56 of stationary plate 58 that itself is disposed perpendicular to the annular flow of fluid in the lower vent sub 60. Fluid is then expelled fully through the most distal portion (foot valve 64) of the lower vent sub 60 to a forward attached assembly or corresponding downhole device.

Figure 9:
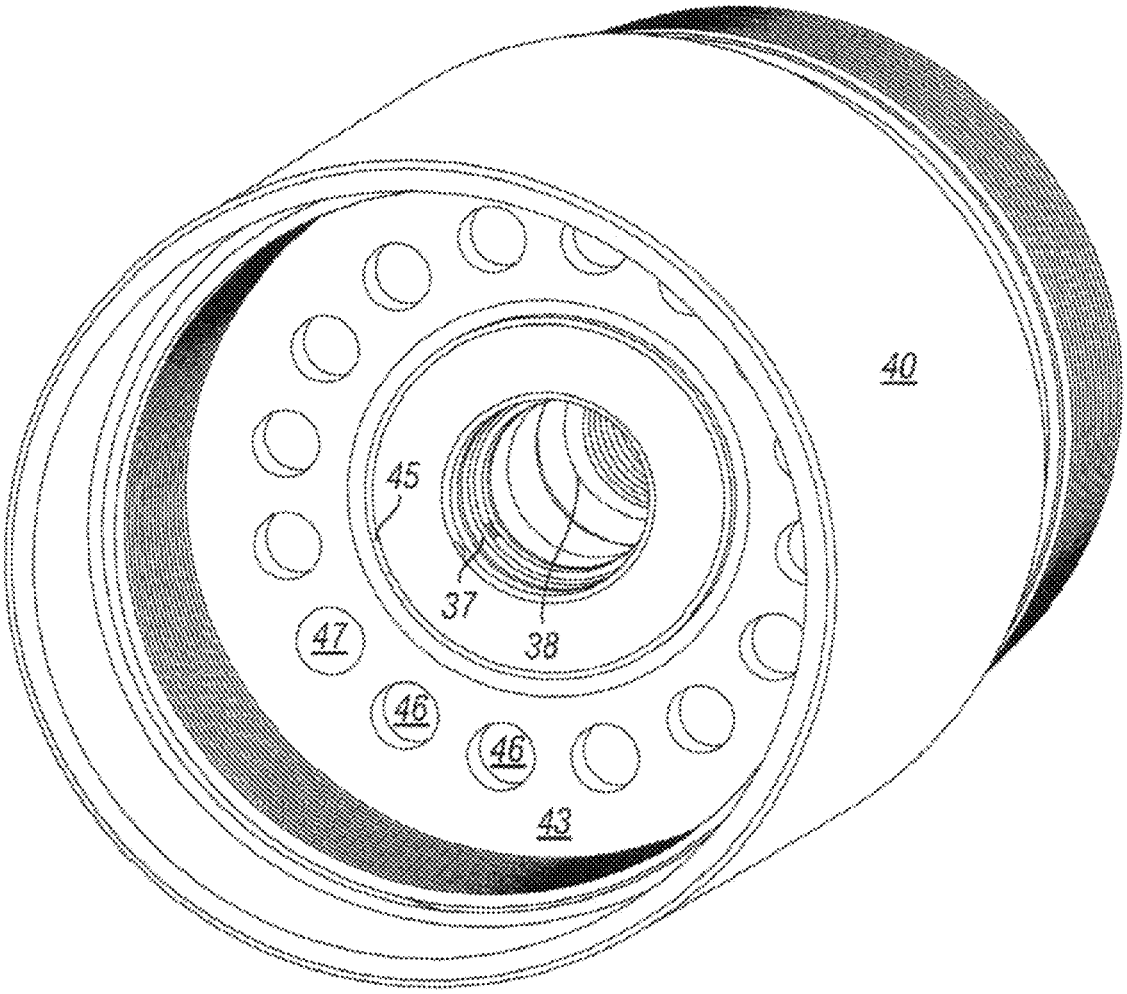
FIG. 9 is a perspective view of the functional components of the bearing valve housing

As depicted in FIGS. 1 and 9, a seal 37 and bearing 38 combination of turbine-shaft assembly 30 can be seen to provide occlusion of the centrally deposed pathway running centrally through the rotating plate 43 and stationary plate 45 thereby obstructing flow and redirecting fluid flow into rotating inlet ports 47, through corresponding stationary inlet ports 46 and into the distal chamber of the bearing valve housing 40.

Figure 7:
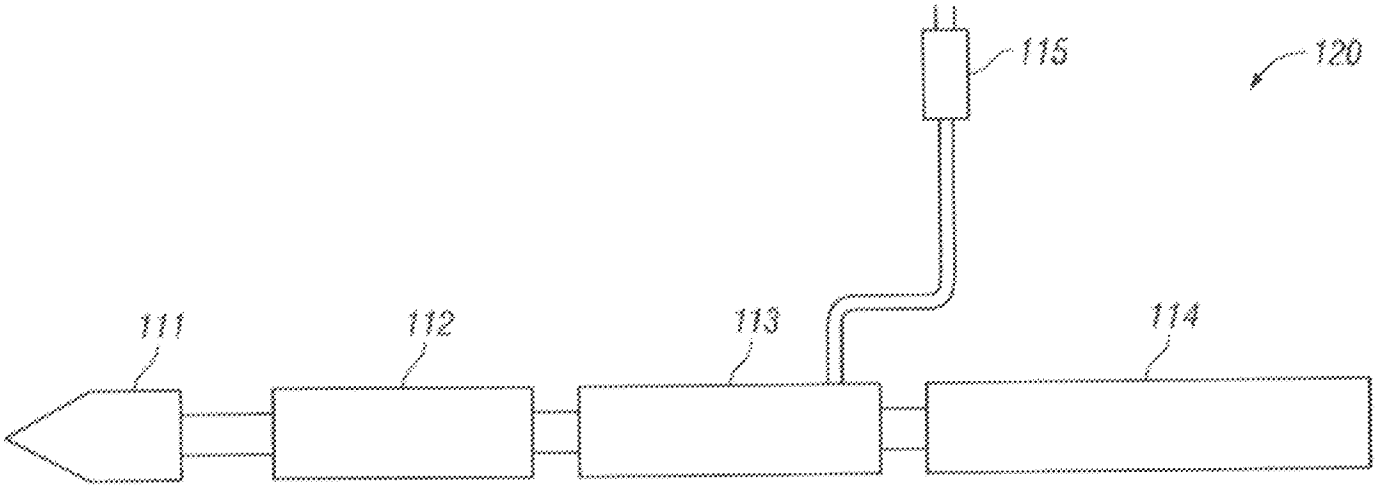
FIG. 7 shows a representation of the digital assembly and brake probe

As well as novel and ergonomic mechanical inventive features, as depicted in FIG. 7, the present invention allows for programming of the assembly to control "on and off" vibration of the tool via communications port 115. The communications port 115 programs the assembly via a laptop computer. The communications port 115 attaches to the microprocessor 114 through the printed circuit board assembly 113 which accepts the codes from a laptop computer to command the tool to operate with specific.

Figure 8:
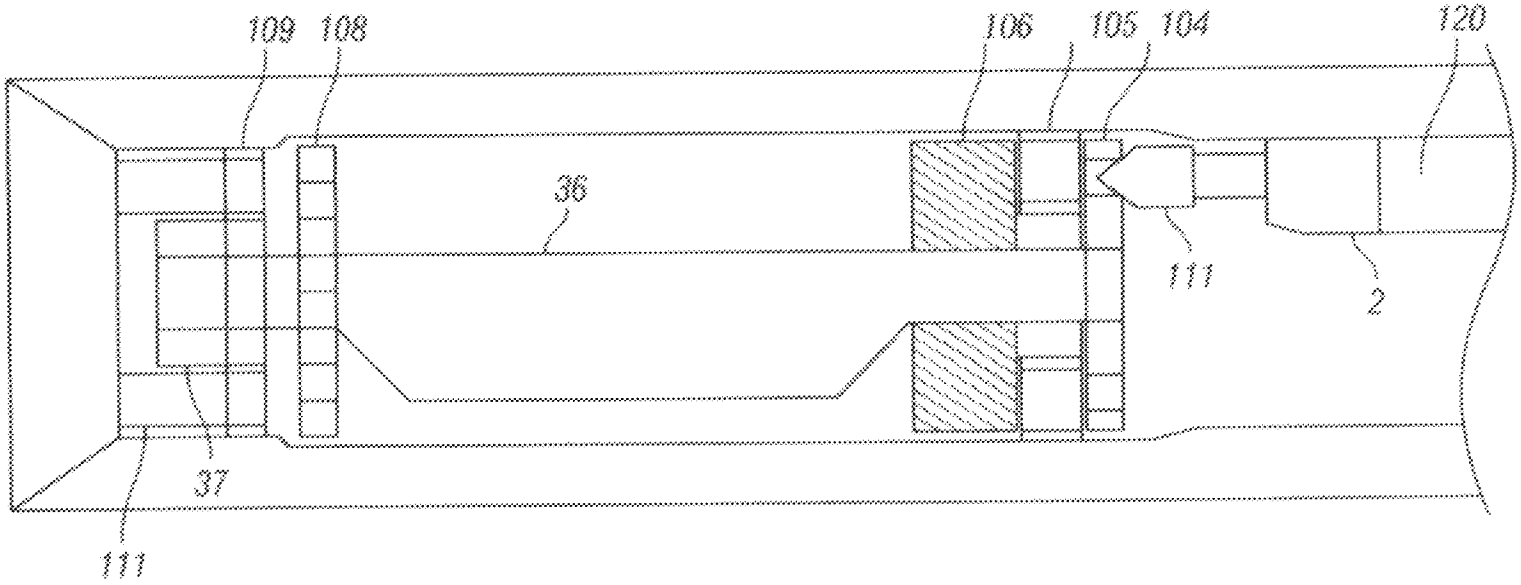
FIG. 8 illustrates a diagrammatical representation of the brake probe and turbine-shaft assembly.

FIG. 8 provides for sensor sensing and memory capacity to hold and store relevant commands that, once certain wellbore conditions or command parameters are met, the tool will activate upon brake probe 111 removal (or deactivate trough brake probe 111 introduction).

The brake probe assembly 120 brake probe 111 is attached to a motor 112 that allows the brake probe 113 to move into the "on and off" position to activate and de-activate the brake probe 113 through either an inlet port orifice 4, 15, 47 or 46 or through the aperture 56 and orifice 55 of the vibratory assembly 100 or vibratory assembly system 110. The motor 112 is attached to a condition determining sensor 113 or sensors that provide the stored commands to activate the tools brake probe 111. The brake probe assembly 120 can be powered by various means such as a turbine or batteries (not shown). In the attached drawings, the power supply 114 is assumed to be a battery assembly. The power supply 114 provides the necessary power to power sensors 113, activate the motor 112 and initiate the brake probe 111. The power supply 114 also provides power to the onboard sensors 113 that provide the trigger instructions to operate the brake probe 113.

As depicted in FIG. 8, the brake probe 113 when in the 'on position' position locates into the brake plate 104 thereby preventing the brake plate 104 (fixed permanently to shaft 36) from rotating even as fluid is pumped through the vibratory assembly 100 and/or the assembly system 110. The brake plate 104 is attached to a rotatable plate via the bearing assembly 105 and assembly shaft 36. With the Brake Probe 111 in the 'on position', the bearing assembly 105 and the shaft 36 (depicted here as a weighted shaft) cannot rotate and does not allow the assembly 100 and/or assembly system 110 to vibrate. However, the flow of fluid to the equipment below the most terminal and distal portion of the assemble 80, such as a mud motor, drill bit or combination of multiple drilling tools known to those in the art (not shown), is unimpaired and unhampered.

Diagrammatically, the shaft 36 is attached to the lower end of the assembly via the lower bearing section. A shear plate 109 (in the form of a stationary, rotating or combination) is atop the lower bearing section 37 and each has multiple through inlet ports 4, 15, 47, 46 (collectively 111) to allow the flow of fluid. These inlet ports 4, 15, 47, 46 (collectively 111) can be of various shapes and sizes to provide variable measures of fluid to pass. A second rotating shear plate 108 is attached to shaft 36. As the rotating shear plate 108 rotates, the rotating shear plate 108 ports pass over the ports on the lower shear plate 109 to align the ports thereby allowing the flow of fluid through the entire assembly 100 and or assembly system 110 and into the tools below. As the rotating shear plate 108 continues to revolve, the ports move to a closed position preventing fluid from passing through the assembly. The closure of these ports between the rotating shear plate 108 and the non-rotating shear plate 109 create back pressure within the assembly which causes lateral movement along the length of the pipe forward and back. By rotating the shear plate 108 at high revolutions per minute, the number of pressure pulses increases to a point where the assembly 100 or assembly system 110 and wellbore pipe is constantly vibrating. As detailed above, the higher the volume of fluid pumped through the turbine 106 the faster the turbine 106 spins the shaft 36 and the more pressure pulses are created at the shear plates 108 and 109. This provides for a multi-axis, lateral and axial vibration effect to occur thereby reducing pipe to pipe friction contact along the length of the pipe and bottom hole assembly via the agitator vibratory assembly 100 as shown and described.

Figure 10:
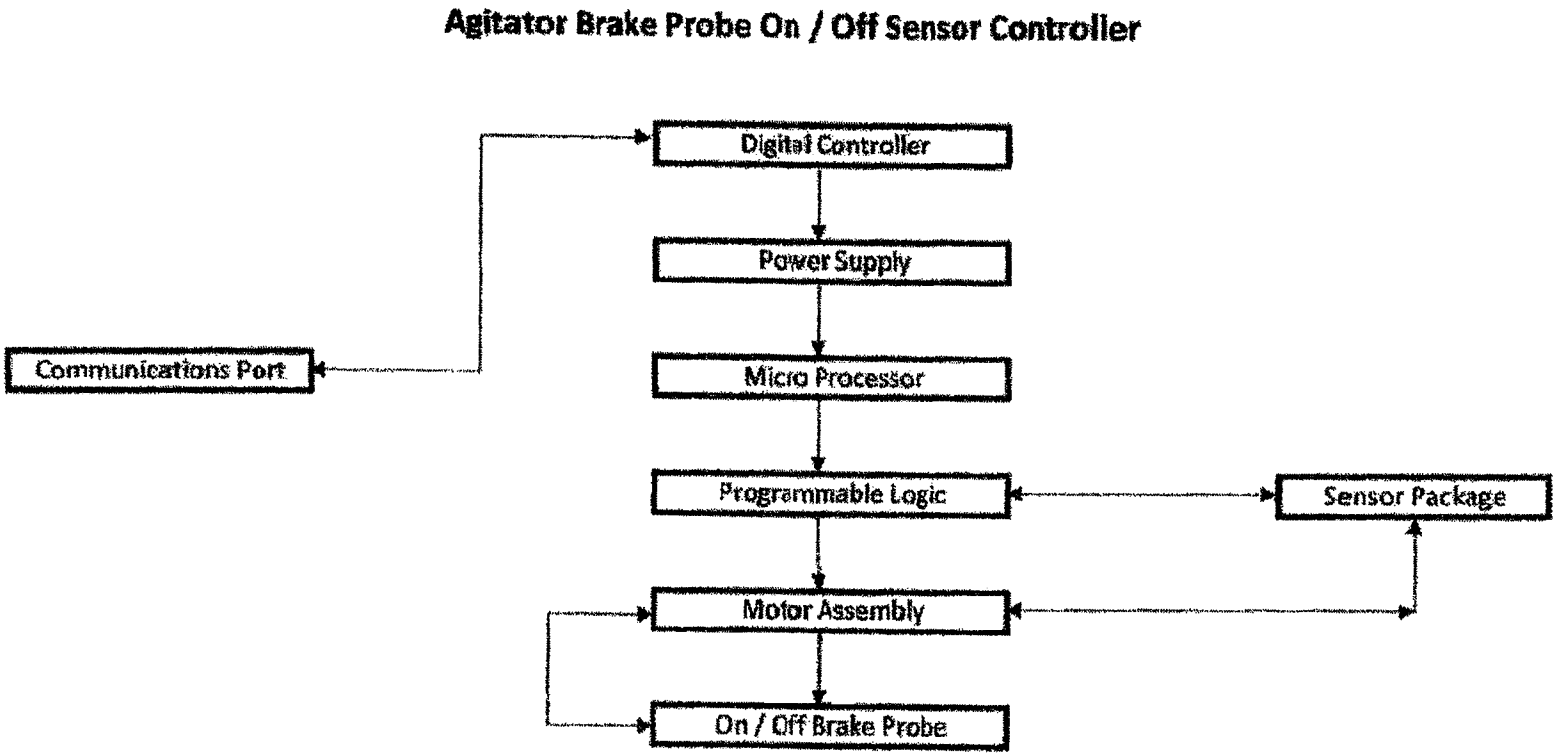
FIG. 10 shows a flow diagram of the printed circuit board, microprocessor, sensors, electrical motor, brake probe and power section.

FIG. 10 shows a flow diagram of the printed circuit board, microprocessor, sensors, electrical motor, brake probe and power section as described in the preceding paragraphs.

Figure 11:
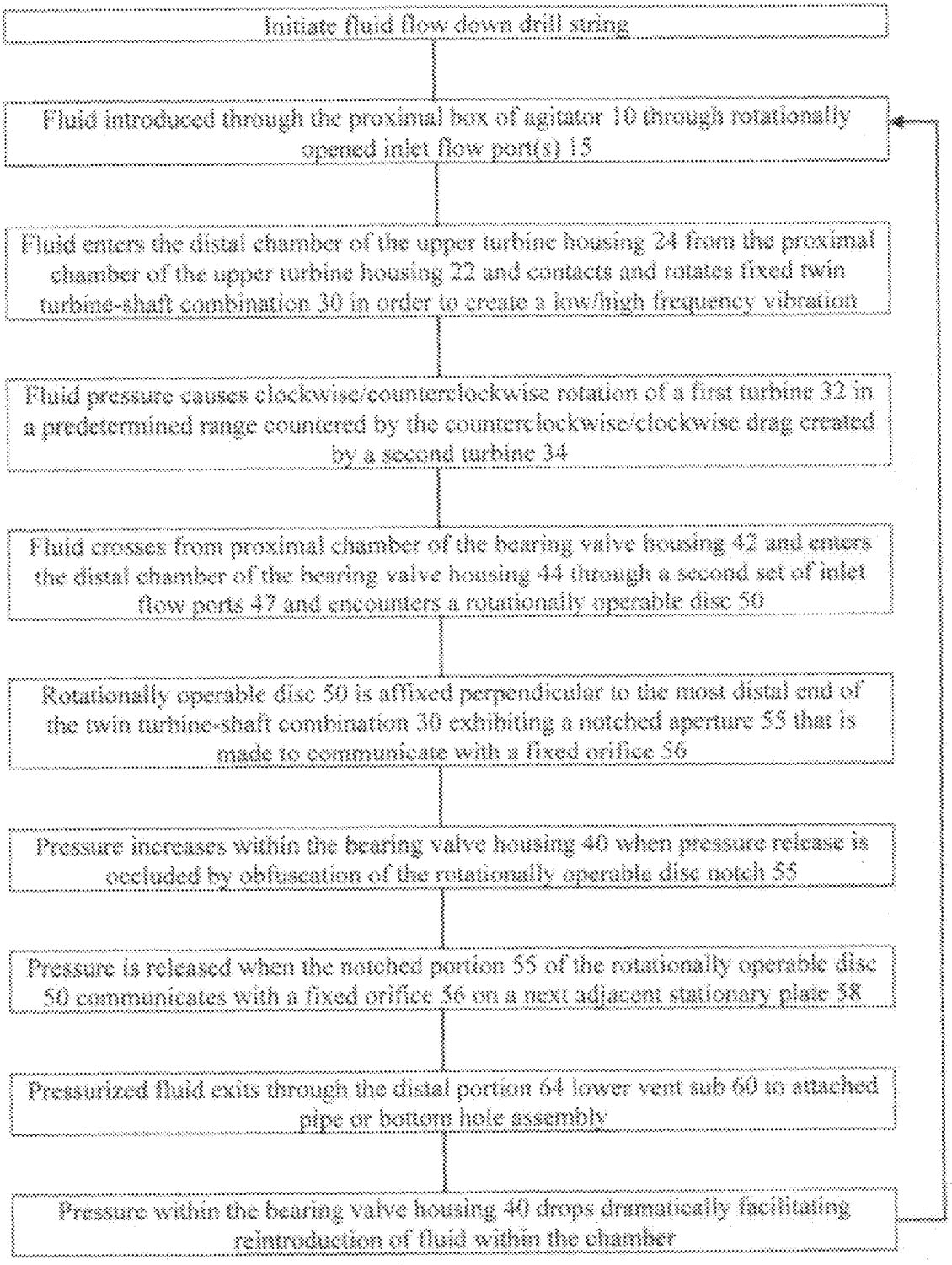
FIG. 11 is a flow diagram of the operational elements of the present invention.

FIG. 11 is a flow diagram of the operational elements of the present invention describing the functional features as described and depicted in the present application. The diagrams and features, though, are merely representational of the primary features if the vibratory assembly and digital circuit assembly and are not drawn to scale or are they meant to provide a direct representation of each defining feature. Augmenting and changing of these features may be attempted without changing the scope or intent of the present application.

Figure 12:
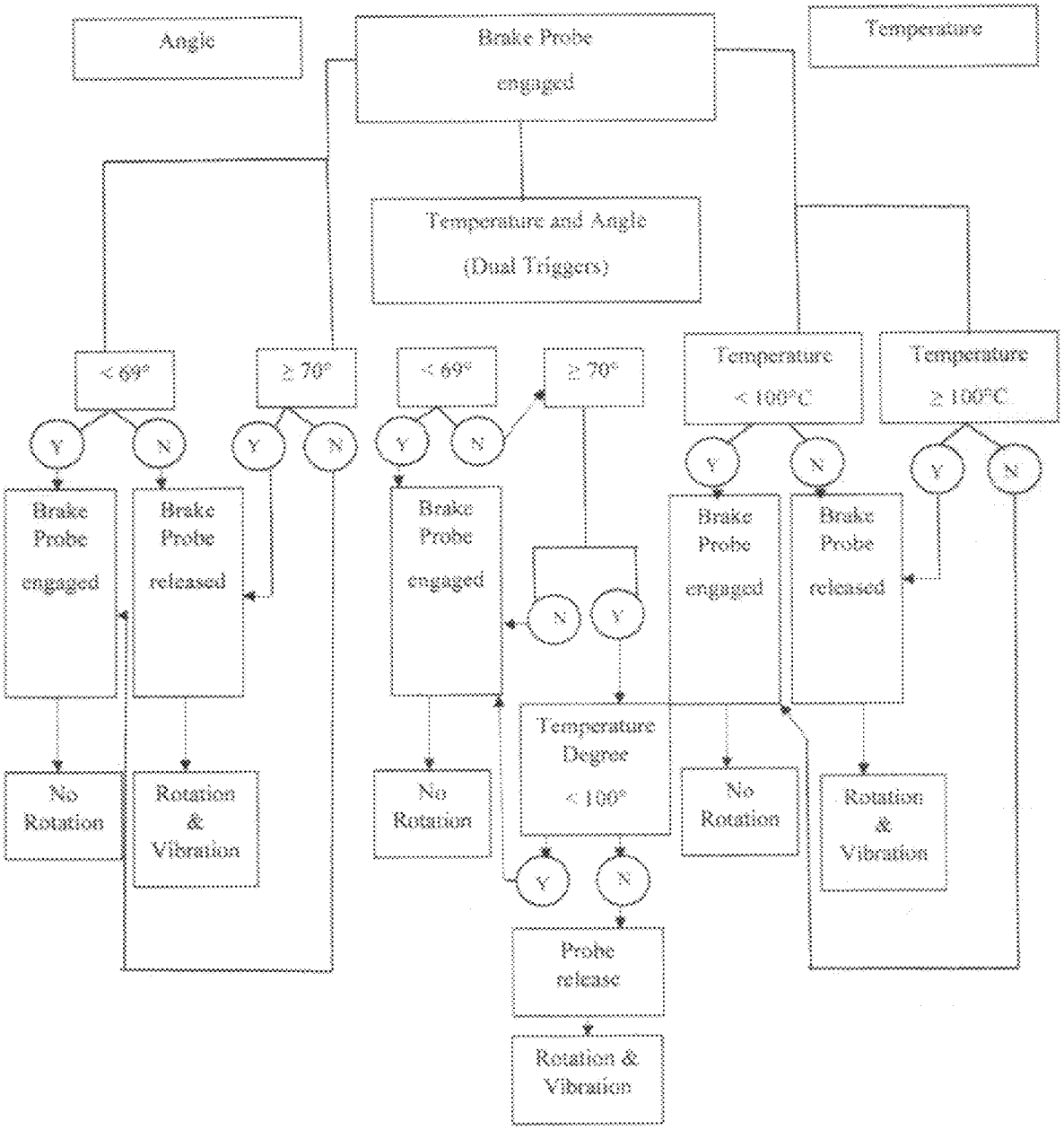
FIG. 12 is a flow diagram of the primary "triggers" single and in combination.

FIG. 12 is a flow diagram of the primary "triggers", singly and in combination. Although, degree and temperature have been provided, and are two of the primary triggers, their inclusion is a practical representation of two of many sensor programs that may be included in the present invention which are variable without departing from the spirit of the invention.

What is claimed is:

1. A vibratory assembly for the agitation of pipe and bottom hole assemblies comprising:

an upper turbine housing, a cylindrical, rotating shaft, a first set of circular plates comprising a first circular rotating plate and a first circular stationary plate, a second set of plates comprising a second circular rotating plate and a second circular stationary plate, rotationally opposing turbines, a bearing valve housing, a circular rotational disc and a lower vent sub housing;

said upper turbine housing encompassing said first circular rotating plate, said first circular stationary plate and said cylindrical, rotating shaft with rotationally opposing turbines;

each circular rotating and stationary plate having a centered orifice and flow ports circumferentially about their peripheries;

each peripheral flow port, in both rotating and stationary plates, approximately uniform in diameter;

said first circular rotating plate running perpendicular to said upper housing's body wherein said first circular rotating plate is made to reside immediately before, and in close relation to said first circular stationary plate;

said first circular stationary plate running perpendicular to said upper housing's body which is made to reside in close relation and immediately after said first circular rotating plate;

peripheral flow ports are made to span the thicknesses of both said first circular rotating plate and said first circular stationary plate;

said first circular rotating plate and first circular stationary plate peripheral ports made to come into and out of communication as fluid is introduced into the assembly, inducing rotation and allowing said first circular rotating plate to facilitate the passage of fluid upon communication of said first circular rotating plate peripheral ports and first circular stationary plate peripheral ports upon fluid-induced rotation of said first circular rotating plate;

said cylindrical rotating shaft attached to said first circular rotating plate proximally and said circular, rotational disc distally;

said cylindrical rotating shaft made to accept said rotationally opposing turbines reversibly via placeable and replaceable keyed inclusion in series;

each turbine made to exhibit flanged fins inducing either clockwise or counterclockwise rotation;

one of said rotationally opposing turbines being responsible for rotation induction and the other of said rotationally opposing turbines responsible for rotation reduction;

said bearing valve housing is an annular, longitudinal housing attached to the distal portion of said upper turbine housing;

said annular, longitudinal bearing valve housing harboring the second set of circular rotating and stationary plates wherein said second circular rotating plate runs perpendicular to said annular, longitudinal bearing valve housing which is made to reside immediately before and in close relation to said second circular stationary plate;

said second circular stationary plate running perpendicular to said annular, longitudinal bearing valve housing made to reside in close relation and immediately after said second circular rotating plate;

said second circular rotating plate and said second circular stationary plate is housed within said bearing valve housing whereby each exhibits peripheral ports that are made to come into and out of communication as fluid is introduced into the assembly allowing said second circular rotating plate to facilitate the passage of fluid upon communication of said peripheral ports of said second circular rotating plate and said second circular stationary plate upon fluid induced rotation of said secondary circular rotating plate;

said circular rotational disc attached to the most distal, terminal portion of said rotating cylindrical rotating shaft;

said circular rotational disc exhibiting a notched aperture across its thickness;

said lower vent sub is an annular, longitudinal housing harboring a terminal stationary plate which is made to run perpendicular to said annular, longitudinal lower vent sub;

said terminal stationary plate exhibiting an orifice across its thickness made to communicate with said circular rotational disc's notched aperture upon fluid induced cylindrical rotating shaft rotation; and a terminal exit port for fluid expulsion upon said circular rotational disc's notched aperture alignment with said terminal stationary plates orifice that is made to attach to a bottom hole assembly.

2. The vibratory assembly of claim 1 wherein fluid is pumped into said upper turbine housing thereby contacting and rotating said first circular rotating plate, facilitating said first circular rotating plate and said first stationary circular stationary plate peripheral port communication, moving fluid across opened peripheral ports causing engagement of said cylindrical rotating shaft, said shaft rotation, said second circular rotating plate rotation and said second stationary circular plate port communication with said rotating plate's ports, said rotation of circular rotational disc's notched aperture to communicate with said exit port in said terminal stationary plate orifice and final forced fluid pulsed exit.

3. The vibratory assembly of claim 2 wherein the central orifice of each said circular rotating and stationary plates is occluded and disallows passage of fluid while communication of said circular rotational plate peripheral ports and circular stationary plate peripheral ports allows for rotational plate movement and fluid movement through said assembly.

4. The vibratory assembly of claim 3 wherein fluid is pumped through said upper turbine housing, said bearing valve housing and said lower vent sub through the rotation induced opening of (1) said communicating peripheral ports and (2) said circular rotational disc's aperture and said terminal stationary plate's orifice communication thereby creating pressure build up and release through fluid obstruction, port communication, fluid release, and fluid translocation across said communicating peripheral ports, said aperture and orifice communication, respectfully.

5. The vibratory assembly of claim 4 wherein fluid entering said upper turbine housing and moving through said communicating peripheral ports is made to forcefully contact said rotationally opposing turbines thereby causing the assembly shaft to rotate and vibrate.

6. The vibratory assembly of claim 5 wherein one turbine exhibits winged fin flanges designed to facilitate rotation in a clockwise direction and the other turbine's winged fin flanges are designed to rotate in a counterclockwise direction, which may also be reversed, where the one turbine functions as a break on the acceleration on the other turbine and the other turbine serves as an accelerator.

7. The vibratory assembly of claim 6 wherein the distal portion of the upper turbine housing and the distal portion of the bearing valve housing experience transitory increases and decreases in pressure as fluid is pumped down a drill string and into each housing sequentially, along the length of the vibratory assembly as said peripheral ports are occluded and opened as fluid travels through from the proximal end to the distal end of said assembly.

8. The vibratory assembly of claim 6 wherein said turbines' winged fin flanges can be configured to derive more or less rotation, vibration and/or more or less pressure buildup through manipulation of their size, number and placement.

9. The vibratory assembly of claim 7 wherein the transitory increases and decreases in pressure in said bearing valve housing is finally released when said circular rotational disc's notched aperture communicates with said terminal stationary plate orifice thereby causing an immediate pressure release in the form of a fluid jet pulse from the bearing valve housing, through the lower vent sub, out of the vibratory assembly's most distal portion and into an attached bottom hole assembly.

10. The vibratory assembly of claim 9 wherein transitory increases and decreases in pressure within said assembly causes multi-axis vibration of said assembly system and retrograde agitation up the drill string.

11. The vibratory assembly of claim 10 wherein fluid transitory increases and decreases in pressure within said assembly causes retrograde agitation up the drill string, multi-axis vibration of said assembly and ultimate release of pressure in advanced of the vibratory system as said fluid jet.

12. The vibratory assembly of claim 11 wherein said vibratory assembly utilizes onboard microprocessors and onboard sensors to initiate commands to start and stop the agitation and vibration of the vibratory system via an internal braking system with or without the introduction of fluid into the vibratory assembly.

13. The vibratory assembly of claim 12 wherein said vibratory assembly utilizes said microprocessors and onboard sensors to monitor said vibratory assembly's environment to determine if certain conditions have occurred thereby initiating commands to activate or deactivate the vibratory functionality of the assembly with or without the introduction of fluid into the vibratory assembly.

14. The vibratory assembly of claim 13 further utilizing an electrical motor commanded by the microprocessor to activate and deactivate said breaking system to an engaged or disengaged position in relation to a brake probe contact allowing said cylindrical rotating shaft rotation to de activated or deactivated thereby allowing vibration of the system to be either allowed or disallowed.

15. The vibratory assembly of claim 14 wherein said microprocessor is programmed to expresses a command starting or stopping said cylindrical rotating shaft when one or more conditions are met wherein the command code can be configured to use any selection of sensors known to the industry to detect pipe angle, weight on bit, torque, pressure, temperature, depth, G force and/or other conditions known to those in the art.

16. The vibratory assembly of claim 15 whereby said internal braking system is initiated and commanded to operate according to the occurrence of certain preprogrammed parameters via said microprocessor and printed circuit board, powered by a battery source, where activation of said braking probe engages and disengages said cylindrical rotating shaft to move the vibratory assembly from a static to active state.

17. The vibratory assembly of claim 15 exhibiting a trigger switch programmed to recognize changes in well conditions such as well angle, temperature or pressure to activate the electrical motor and brake probe.

18. The vibratory assembly of claim 15 exhibiting a trigger switch programmed to recognize changes in a downhole tool or bottom hole assembly conditions such as weight on bit, torque, G force, tensile force and another selection sensor triggers known to those in the art of downhole sensor tools in order to operate engage and disengage said internal braking system.

19. The vibratory assembly of claim 15 exhibiting a trigger switch that has a time delay function that disables said braking system activation until the pre-programmed time delay has elapsed.

20. The vibratory assembly of claim 15 wherein the sensors may be timed to correspond to descension, ascension or both.

21. The vibratory assembly of claim 1 wherein said peripheral ports can be constructed and configured to derive more or less vibration and more or less fluid pressure buildup and release through manipulation of their number, size, placement, occlusion and configuration.

22. The vibratory assembly of claim 1 wherein said turbines are designed for keyed inclusion, replacement and interchange for optimization of vibration and fluid pressure flow.

23. The vibratory assembly of claim 1 wherein two to or more of said vibratory assemblies may be aligned in series wherein a combination of upper turbine housings, bearing valve housings and vent subs, may be configured and reconfigured to allow for multiple frequency generations from high to low and low to high frequencies to produce various multi axis vibration effects on the pipe and bottom hole assembly.

24. The vibratory system of claim 1 wherein said cylindrical rotating shaft is an offset weighted shaft.

25. The vibratory system of claim 1 wherein said circular rotational disc's notched aperture can be expanded or decreased to cause less or more expelled fluid.

26. The vibratory system of claim 1 wherein said terminal stationary plate orifice can be expanded or decreased to cause less or more fluid to be expelled.

27. A method for causing agitation via a vibratory agitator assembly in a well bore comprising the steps of:

initiating fluid flow down a drill string and into the proximal end of said vibratory agitator assembly;

said agitator assembly having 3 primary components: an upper turbine housing, a bearing valve housing, and a lower vent sub;

introducing fluid from said drill string, through the proximal end of said assembly and into the upper turbine housing of said agitator assembly wherein said upper turbine housing encompasses a first set of plates comprising a first circular rotating plate and a first circular stationary plate and a rotating shaft connected to said first circular rotating plate;

said rotating shaft exhibiting a pair of finned turbines reversibly affixed to the lower third of the outer circumference of said rotating shaft;

said first circular rotating plate and first circular stationary plate having a centrally deposed aperture accepting said rotating shaft and inlet flow ports placed about each plate's periphery;

said upper turbine housing causing pressure increases and decreases via said rotating and stationary plates' ports communication and uncommunication;

rotating said first circular rotating plate via fluid introduction so that inlet flow ports existing about the perimeter of said first circular rotating plate come into communication with corresponding inlet flow ports on a said first circular stationary plate to allow fluid buildup and release into the distal portion of said upper turbine housing;

causing vibration in said agitation assembly through (a) pressure increases in the upper turbine housing up to the point of inlet port communication between said rotating and stationary plates and (b) pressure decreases upon rotating and stationary plate inlet port communication;

said pressure increases and decreases sending retrograde vibratory pulses directed back up said drill string and along pipe laying in a horizontal well section;

connecting to said rotational shaft, said pair of finned turbines;

said shaft centrally located in the annular space of said vibratory assembly and made to transfer rotational force from said first rotational plate, across finned turbines and through to a second set of rotational and stationary plates and to an appended rotating disc within the distal portion of said bearing valve housing;

said shaft exhibiting reversibly affixed, finned twin turbines to positively or negatively effect shaft rotation;

continuing rotation of said first circular rotating plate and rotational shaft via fluid introduction and fluid pressure until a next communication of said inlet flow ports again allows fluid build and release into the distal portion of the upper turbine housing;

causing rotation of said shaft via rotation of attached said first circular rotating plate and said turbines affixed to said shaft;

causing fluid movement via clockwise/counterclockwise rotation of a first of said finned turbines in a predetermined range countered by the counterclockwise/clockwise drag created by a second of said finned turbines in a predetermined range;

causing fluid movement into the next assembly housing a bearing valve housing;

causing fluid movement into the distal portion of the bearing valve housing, through a second set of inlet flow ports within the second set of plates; causing vibratory inducing pressure to build behind said second set of plates until second rotating and stationary plate inlet ports communication occurs;

causing pressure decrease within said bearing valve housing with inlet port communication;

said pressure increases and decreases causing vibratory pulses within the vibratory assembly itself;

causing said fluid and pressure to move through said second inlet port communication to a third rotationally operable circular disc appended to the most distal end of said rotational shaft and into a lower vent sub;

said third rotationally operable circular disc exhibiting a notched aperture or apertures made to communicate with a fixed orifice exhibiting a terminal stationary plate with corresponding aperture or apertures;

said fixed orifice terminal stationary plate securedly affixed within said lower vent sub;

allowing for pressure buildup up to the point of aperture (s) and orifice(s) communication;

allowing for increasing pressure within the bearing valve housing where pressure release is occluded by obfuscation of the rotationally operable disc aperture(s) and orifice(s); allowing for releasing of pressure, as a forceful jet pulse, when said notched portion or portions of the rotationally operable disc communicates with a fixed orifice or orifices on said terminal stationary plate;

causing forceable exit of pressurized fluid through and out of the distal portion of said assembly, from an area of high pressure behind the terminal stationary plate to low pressure in front of said terminal stationary plate, and into an attached pipe or bottom hole assembly; and causing pressure within the bearing valve housing to drop dramatically thereby facilitating the reintroduction of fluid into said proximal end of said assembly, through said upper turbine housing, through said bearing valve housing and lower vent sub of the agitation assembly to again build and release pressure and rotate said shaft to cause both vibration and forceful jet pulses.

* * * * *